US006205815B1

(12) United States Patent
Bruder et al.

(10) Patent No.: US 6,205,815 B1
(45) Date of Patent: Mar. 27, 2001

(54) PLANT FOR SEPARATION OF A GAS MIXTURE BY DISTILLATION

(75) Inventors: Olivier Bruder, Neuilly-sur-Seine; Bernard Darredeau, Sartrouville; Jean-Yves Lehman, Maisons-Alfort, all of (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/571,736

(22) Filed: May 15, 2000

Related U.S. Application Data

(62) Division of application No. 09/059,046, filed on Apr. 13, 1998.

(30) Foreign Application Priority Data

Apr. 11, 1997 (FR) ..... 97 04484

(51) Int. Cl.[7] ..... F25J 3/00; F25J 5/00
(52) U.S. Cl. ..... 62/643; 62/905; 62/911
(58) Field of Search ..... 62/643, 646, 902, 62/905, 911

(56) References Cited

U.S. PATENT DOCUMENTS

| | | | | |
|---|---|---|---|---|
| 1,211,125 | | 1/1917 | Fonda . | |
| 3,108,867 | | 10/1963 | Dennis . | |
| 3,127,260 | | 3/1964 | Smith . | |
| 4,897,098 | | 1/1990 | Patel et al. . | |
| 5,295,356 | | 3/1994 | Billy . | |
| 5,505,051 | | 4/1996 | Darredeau et al. . | |
| 5,673,571 | | 10/1997 | Manley . | |
| 5,730,004 | | 3/1998 | Voit . | |
| 5,735,141 | * | 4/1998 | Whitlock | 62/620 |
| 5,896,755 | * | 4/1999 | Wong et al. | 62/643 |
| 6,128,921 | * | 10/2000 | Guillard et al. | 62/643 |

FOREIGN PATENT DOCUMENTS

| | | |
|---|---|---|
| 26 33 272 | 1/1978 | (DE) . |
| 0 628 777 | 12/1994 | (EP) . |

* cited by examiner

*Primary Examiner*—William Doerrler
(74) *Attorney, Agent, or Firm*—Young & Thompson

(57) ABSTRACT

A plant for separation of a gas mixture comprises at least two columns which are of the same length. The tops of two of the columns are at the same height.

4 Claims, 2 Drawing Sheets

PLANT FOR SEPARATION OF A GAS MIXTURE BY DISTILLATION

CROSS-REFERENCE TO RELATED APPLICATIONS

This application is a division of copending application Ser. No. 09/059,046, filed Apr. 13, 1998.

FIELD OF THE INVENTION

The present invention relates to a plant for separation of a gas mixture by distillation and, in particular, by cryogenic distillation.

BACKGROUND OF THE INVENTION

In cryogenic distillation plants, a number of distillation columns are contained in a cold box so as to insulate them from the ambient heat. The height of the cold box is generally determined by the length of the longest column. At the present time, in order to produce argon with less than 1 ppm of oxygen cryogenically, up to 250 trays have to be fitted into the argon column which makes the cold box very tall and causes instability problems. In addition, it contains many empty spaces which must be filled with insulating material.

DE-A-2633272 describes a double column with a low-pressure column in two sections, the tops of the two sections being at the same height.

SUMMARY OF THE INVENTION

The aim of the present invention is to make cold boxes more compact and to reduce the empty spaces inside them.

One object of the invention is to provide a plant for separation of a gas mixture by distillation, which comprises at least two columns, the tops of two of the columns being at the same height, characterized in that at least two of the columns are of the same length.

According to other aspects of the invention, provision is made so that:

- two of the columns are of the same length and the tops of these columns are at the same height,
- the tops of the three of the columns are at the same height,
- the tops of all of the columns are at the same height,
- the columns are designed for the separation of air and comprise a first column which is capable of operating at a medium pressure, a second column comprising two sections which are capable of operating at a low pressure, the first column and the first section being thermally coupled by a reboiler/condenser, means for sending fluids from the first column to the second section and means for sending a gas at the top of the first section to the collector of the second section and a liquid in the collector of the second section to the top of the first section, the second section optionally being of the same length as the length of the first section and of the first column,
- four columns are designed for the separation of air, including two designed for the separation of an argon-enriched mixture,
- one of the columns is shorter than at least one of the others and a storage tank is located in the space beneath this shorter column.

BRIEF DESCRIPTION OF THE DRAWINGS

An illustrative embodiment of the invention will now be described with regard to the appended drawings in which.

DETAILED DESCRIPTION OF THE DRAWINGS

Figure 1:
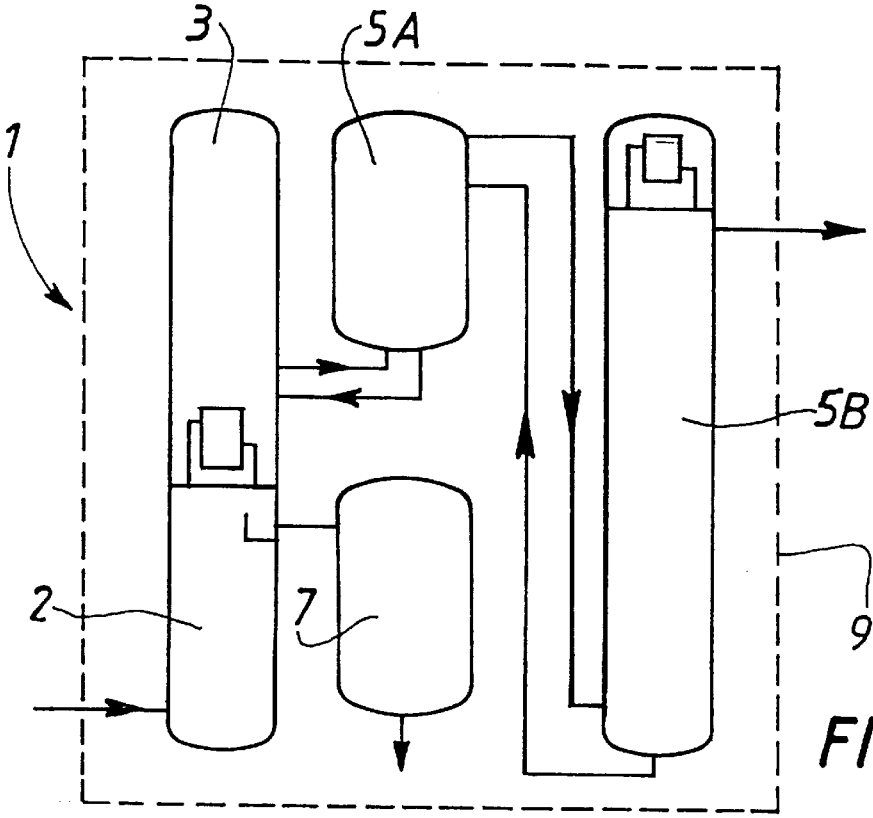
FIG. 1 diagrammatically represents a plant for production of oxygen and argon according to the invention.

FIG. 1 shows a double column 1 consisting of a medium-pressure section 2 and a low-pressure section 3 which are thermally coupled by a reboiler/condenser. An argon production unit in two columns 5A, 5B is fed with an argon-enriched fluid coming from the low-pressure section of the double column 1. The tops of the two columns 5A, 5B of the argon production unit and of the low-pressure column 3 lie at the same level.

This arrangement corresponds to that in EP-A-628 777, this document not however disclosing that the tops of the columns are all at the same level.

A liquid-nitrogen storage tank 7 is situated in the space beneath the first argon column 5A.

The cold box 9 contains the double column 1, the argon columns 5A, 5B and the storage tank 7.

Figure 2:
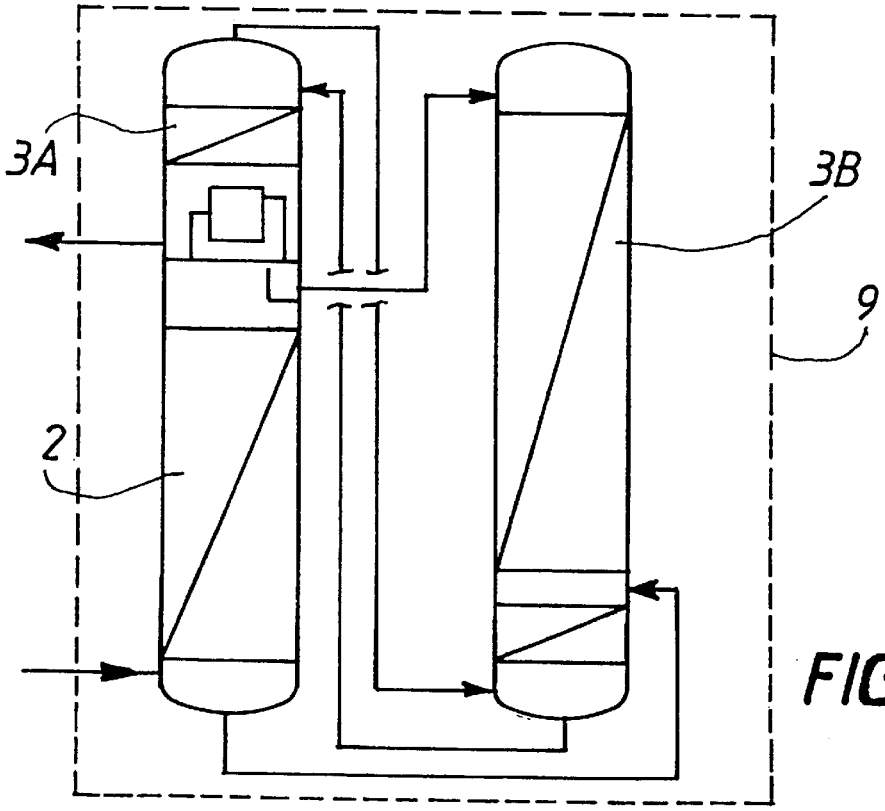
FIG. 2 diagrammatically represents a plant for production of nitrogen and oxygen according to the invention.

FIG. 2 shows a double column consisting of a medium-pressure section 2 and a low-pressure section 3A. A low-pressure column 3B is serially connected to the low-pressure section 3A.

The tops of section 3A and column 3B are at the same level. The collector of the low-pressure column 3B is fed with gas from the top of section 3A and liquid is sent from the collector of the low-pressure column 3B to the top of section 3A.

The length of the low-pressure column 3B is identical to the total length of the double column made up of low-pressure section 3A and medium-pressure section 2.

Figure 3:
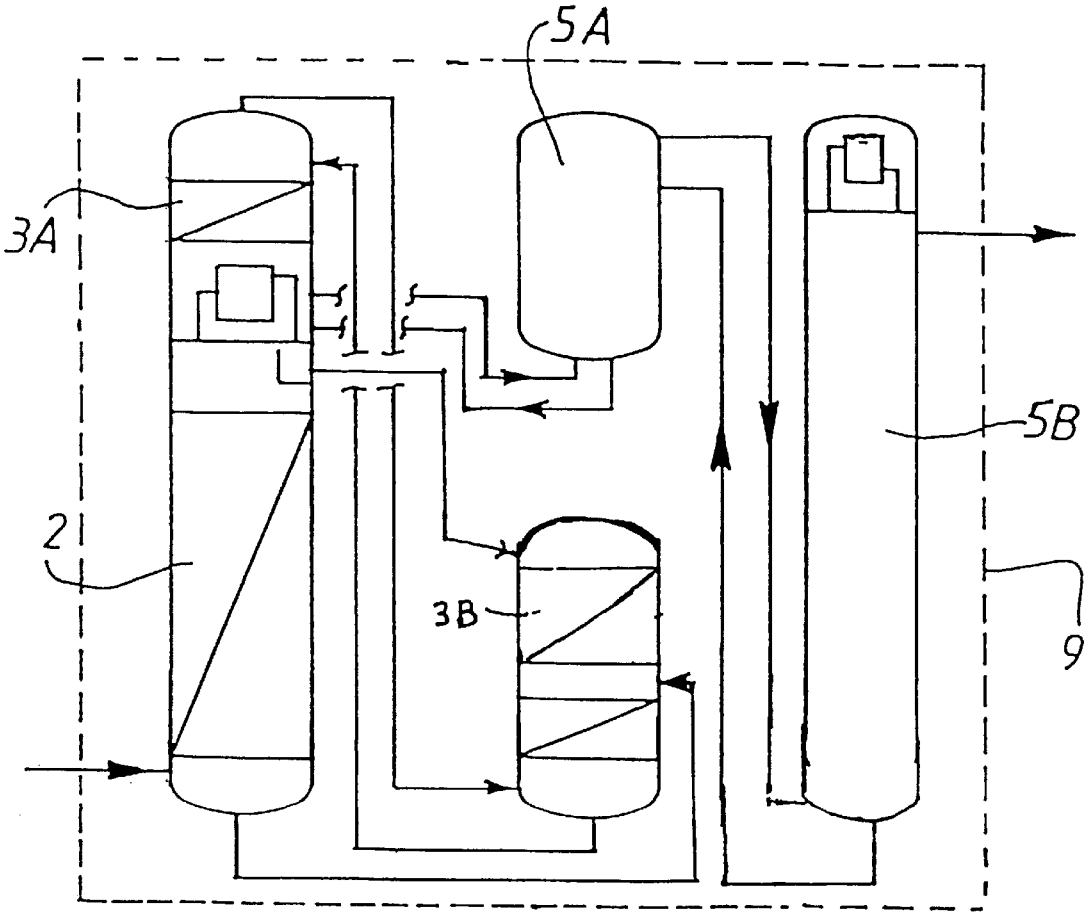
FIG. 3 diagrammatically represents a plant combining the concepts of FIGS. 1 and 2.

The concepts shown in FIGS. 1 and 2 could conceivably be combined with a plant comprising a medium-pressure column 2, a low-pressure column in two sections 3A, 3B and an argon column in two sections 5A, 5B. In this case, as shown in FIG. 3, the section 3B of the low-pressure column could be situated beneath the section 5A of the argon column (or vice versa).

FIG. 2 could, of course, be adapted to comprise an argon column fed by the sections 3A, 3B of the low-pressure column.

Of course, the plant shown in FIG. 1 could comprise an oxygen, nitrogen or argon storage tank beneath the section 5A.

What is claimed is:

1. Plant for separating a gas mixture by distillation, which comprises:

- a first column structure and a second column structure;
- each column structure having a top and a base;
- the top of the first column structure and the top of the third column structure being at the same level, and the first and second column structures having substantially the same height;
- the first column structure comprising a first column and a first section of a second column, and the second column structure comprising a second section of the second column;

the top of the first column being thermally linked with the base of the first section by means of a condenser reboiler;

means for feeding the gas mixture to the first column of the first column structure;

means for sending fluids from the first column to the second column;

means for transferring fluid to the top of the first section from the bottom of the second section;

means for transferring fluid from the top of the first section to the bottom of the second section; and means for withdrawing fluid from the second column.

2. The plant according to claim 1, further comprising means for withdrawing fluid from the first section of the second column.

3. The plant according to claim 1, further comprising means for sending fluids from the first column to the second section of the second column.

4. The plant according to claim 1, further comprising means for sending fluid from the top of the first column to the top of the second section of the second column.

* * * * *